United States Patent [19]

Hunt

[11] Patent Number: 4,687,192

[45] Date of Patent: Aug. 18, 1987

[54] SHEET FEED APPARATUS WITH FIXED SEPARATOR PROTRUSIONS

[75] Inventor: Ronald E. Hunt, Georgetown, Tex.

[73] Assignee: International Business Machines Corporation, Armonk, N.Y.

[21] Appl. No.: 183,702

[22] Filed: Sep. 3, 1980

[51] Int. Cl.[4] ..... B65H 3/06

[52] U.S. Cl. ..... 271/119; 29/121.1; 29/132

[58] Field of Search ..... 271/119, 120, 37, 38; 29/121.1, 132

[56] References Cited

U.S. PATENT DOCUMENTS

| | | | |
|---|---|---|---|
| 182,105 | 9/1976 | Covert . | |
| 245,608 | 8/1981 | Burk . | |
| 396,594 | 1/1889 | Pellatt | 271/119 |
| 566,670 | 8/1896 | Dummer . | |
| 1,357,070 | 10/1920 | Matthews . | |
| 1,718,467 | 6/1929 | LaBarre . | |
| 2,764,409 | 9/1956 | LaBombard | 271/120 X |
| 3,161,130 | 12/1964 | Vogel | 29/132 X |
| 3,220,605 | 11/1965 | Casey | 221/231 |
| 3,630,516 | 12/1971 | Hong | 271/36 |
| 4,126,305 | 11/1978 | Colglazier | 271/37 X |

OTHER PUBLICATIONS

IBM Technical Disclosure Bulletin, vol. 22, No. 1, Jun. 1979, p. 21, "Document Feed System", L. Rose et al.

*IBM Technical Disclosure Bulletin,* "Wave Generator Paper Separation System", vol. 20, No. 12, May 1978, pp. 5119–5120.

*Primary Examiner*—Richard A. Schacher

*Attorney, Agent, or Firm*—John W. Henderson, Jr.; Douglas H. Lefeve

[57] ABSTRACT

A rotatable feed wheel for use in a sheet shingling apparatus having fixed, relatively round protrusions spaced about its outer surface which contact and shingle sheets of paper. The rotatable feed wheel is unitarily constructed and its surface which contacts the sheets of paper is made of a material which produces a lower coefficient of friction between the wheel protrusions and the outermost sheet being shingled than the coefficient of friction between the outermost sheet of paper and its adjacent sheet in the stack.

9 Claims, 4 Drawing Figures

SHEET FEED APPARATUS WITH FIXED SEPARATOR PROTRUSIONS

BACKGROUND OF THE INVENTION

1. Field of the Invention

The present invention relates to sheet paper feed apparatus for a typewriter, and more particularly relates to sheet paper feed apparatus including means for removing a single sheet of paper from a stack and feeding the same to the platen of the typewriter.

2. Description of the Prior Art

Shingling apparatus for separating sheets and feeding the same have been in existance for some time. For example, see U.S. Pat. No. 3,008,709 issued on Nov. 14, 1961 to Buslik. The use of such shingling apparatus has been varied but conventionally has been employed in conjunction with some normal force to remove either the topmost or bottom-most sheet from a stack of sheets of paper. Typical bottom sheet shingling apparatus is illustrated in *IBM TECHNICAL DISCLOSURE BULLETIN*, Vol. 21, No. 9, February 1979, pages 3538–3539 and 3540–3542; and U.S. Pat. No. 4,165,870, issued on Aug. 28, 1979 to John L. Fallon, et al. Typical top sheet shingling apparatus is illustrated in *IBM TECHNICAL DISCLOSURE BULLETIN*, Vol. 20, No. 12, May 1978, pages 5119–5120; and copending U.S. patent application, Ser. No. 053,462, filed June 29, 1979 by R. E. Hunt.

In feeding individual sheets of paper to the platen of a typewriter, it is particularly advantageous if the sheet feeder can distinguish a single sheet of paper and present that single sheet of paper without additional drive or feed rolls for insuring separation to the platen of the typewriter inasmuch as this complicates the apparatus.

In the prior art such sheet feed apparatus employed friction rollers or wheels having high surface friction characteristics relative to the friction between the sheets to be separated and fed. Typical of such prior art is U.S. Pat. No. 1,357,070 issued Oct. 26, 1920 to Thomas A. Matthews which included a roller that was polygonal or fluted to form ribs for better frictional contact with the sheets. Similarly U.S. Pat. No. 3,630,516 issued Dec. 28, 1971 to Byung S. Hong included a paddle wheel roller with blades made of an elastomeric material having high surface friction characteristics, such as gum rubber. Another type of prior art sheet feed apparatus employed a relatively large wheel having a plurality of smaller wheels mounted about its periphery on bearings. In this arrangement the surface of the smaller wheels was usually constructed of a material having a relatively high coefficient of friction. An example of this type of sheet feed apparatus is shown in *IBM TECHNICAL DISCLOSURE BULLETIN*, Vol. 20, No. 12, May 1978, pages 5119–5120 and copending U.S. patent application Ser. No. 053,462 filed June 29, 1979 by R. E. Hunt.

The sheet feed wheel (shingler wheel) used in each of the prior art paper feed devices is relatively inefficient and expensive due to frictional wear and distortion and complexity of design. These prior art shingler wheels were also relatively noisy in operation due to the many moving parts.

It is therefore an object of the present invention to provide a shingler wheel that is simple in construction, efficient to operate and inexpensive.

SUMMARY OF THE INVENTION

The present invention provides a sheet shingling apparatus in which the rotatable feed wheel has fixed, relatively round protrusions spaced about its outer surface which contact and shingle the paper. The feed wheel is unitarily constructed and its surface coated with a material which produces a lower coefficient of friction between the wheel protrusions and the outermost sheet of paper being shingled than the coefficient of friction between the outermost sheet and its adjacent sheet of paper in the stack. Typically the base feed wheel may be injection molded from Acrylonitrile-Butadiene-Styrene (ABS) plastic and plated with bright nickel or polished chrome.

DESCRIPTION OF THE PREFERRED EMBODIMENT

Figure 1:
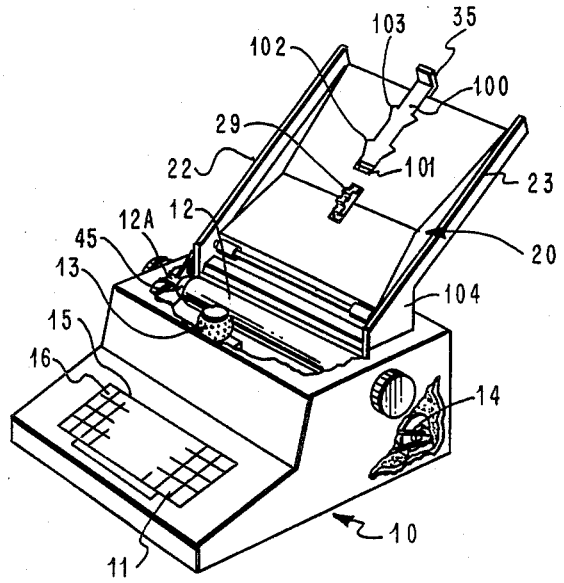
FIG. 1 is a fragmentary perspective view of a typewriter incorporating a sheet feed apparatus including a feed wheel constructed in accordance with the present invention for feeding sheets from the bottom of a stack of sheets.

Referring now to the drawing and especially FIG. 1 thereof, a typical single element typewriter 10 having a sheet feeder 20 incorporating the features of the present invention is illustrated therein. As shown, the typewriter 10 includes a keyboard and the like 11, a platen 12 and a typing element 13 which moves longitudinally of the platen 12 by means of a carrier (not shown) to imprint through, for example a ribbon, indicia on paper wound in a conventional manner around the platen 12. In the present instance, the typewriter 10 includes a stepping motor and the like 14 which is coupled to the platen 12 to effect indexing of the platen 12 (and thus a sheet or sheets of paper) either under operation of the operator as through a keybutton 15, automatically through preprogramming or through the conventional carrier return key located on the typewriter 10.

Figure 2:
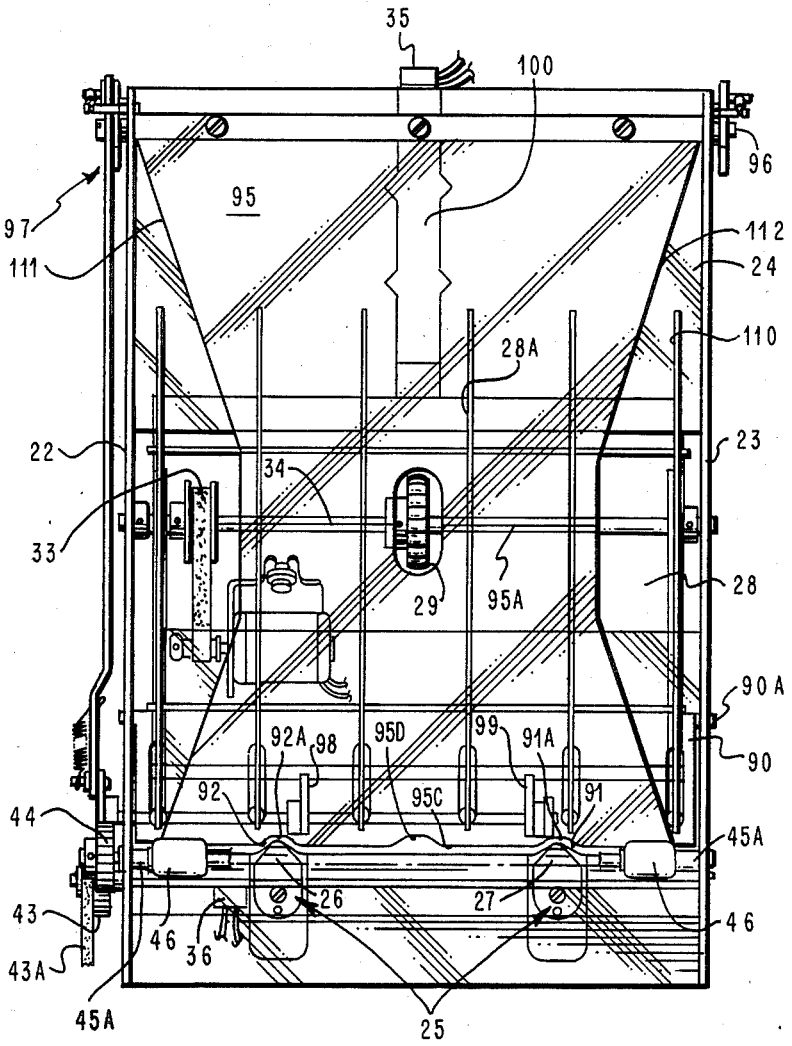
FIG. 2 is a plan view of the sheet feeder illustrated in FIG. 1.

The sheet feeder 20, including its simple electronics is described more fully in copending patent application Ser. No. 85,826 of Quinn, filed on Oct. 17, 1979 and owned by the assignee of the present invention, that application being herein incorporated by reference. The sheet feeder 20 is adapted to receive a stack or bundle of sheets of paper, remove the bottom sheet from the bundle and present the same to the platen 12 of the typewriter 10, and receive the finished sheet, if desired, from the platen 12. This is accomplished by first shingling the stack or bundle so that the bottom-most sheet moves in a first direction away from the typewriter platen 12, and upon sensing of the single sheet, the direction of movement of the shingler wheel 29 is reversed to place the individual sheet between the nip of drive rolls which are conveniently coupled to the platen 12. Thereafter the paper is fed to the platen 12 so that as the platen 12 rotates, the paper sheet is removed from the sheet feeder 20. To this end, and referring now to FIGS. 1–2, the sheet feeder 20 comprises a generally rectangular tray having upstanding sidewalls 22 and 23 which are spaced apart a sufficient distance to receive a bundle or stack of paper (not shown) upon which characters or other indicia may be imprinted by the typewriter 10. The tray includes a rear paper bundle or stack support portion 24, and a spaced apart forward paper support portion 25, the rear paper support portion 24 comprising a ledge or shelf while the forward paper support portion 25 preferably comprises a pair of laterally spaced apart projecting fingers 26 and 27. As best illustrated in FIG. 2, the forward and rear paper support portions 25 and 24 respectively are spaced apart so as to provide an opening 28 therebetween for receiving at least one shingler wheel 29 which projects upwardly into the space 28 above the plane formed by connecting the rear paper support portion 24 and the forward support portion 25 so that a stack of paper, supported by the rear support portion 24 and forward support portion 25, will rest intermediate its ends upon the shingler wheel 29 holding the paper stack or bundle in a slightly bowed configuration. Thus the shingler wheel 29 engages the bottom-most sheet of the paper sheet stack.

In order to impart rotation to the shingler wheel 29 to remove the bottom-most sheet from the bundle or stack, drive means 34, for example a DC motor is coupled through a belt 32 to a pulley 33 mounted on a shaft 34 upon which is mounted the shingler wheel 29. For noise and vibration inhibiting purposes, the DC motor 34, shingler wheel 29 as well as other portions of the apparatus may be mounted on a shock mounted platform.

Upon depression of a pack or paper feed button 16 on the typewriter keyboard 11, (FIG. 1) the DC motor drive means 34 will effect rotation of the shingler wheel 29 in a direction to effect shingling of the lower sheet of a stack or bundle in a first direction which is upwardly or away from the platen 12 of the typewriter 10 (hereafter, up refers to the direction of sheet movement away from the platen 12 and down refers to the direction of sheet movement towards the platen 12). Shingling continues until the lowermost sheet is driven so that its lower edge drops off the forward support portion 25 or off the fingers 26 and 27. This condition is sensed by an upper or top sensor 35 which causes a reversal of the direction of motion of the DC motor 34 and thus a reversal in the direction of the motion of the shingler wheel 29.

After sensing of the bottom-most sheet of paper, by the sensor 35, and reversal of the motor drive 34 of the shingler wheel 29, the bottom-most sheet, having dropped below the forward support portion 25 or fingers 26 and 27, is fed into and between driven rollers 46 and idler rollers (not shown) which are mounted beneath each of the fingers 26 and 27. Adjacent the rollers is a second sensor means or a lower sensor 36 (FIG. 2) which serves to shut off the drive motor 34 stopping the shingling action.

The rollers are mounted on a shaft which extends transversely of the tray 21 and is coupled through a driven gear 43 to a second driven gear 44, the purpose of the second driven gear 44 being more fully explained hereinafter. Preferably a belt 43*a* may be employed to connect the driven gear 43 to the typewriter platen 12, or any other convenient drive which would allow either manual rotation of the platen 12 to effect removal of the paper, or motorized movement of the platen 12 as by the motor 14 associated with the typewriter 10 to move the paper through the platen 12 to a start of typing or print position. It should be recognized, however, that the coupling of the rollers to effect rotation thereof may be by any convenient mode or means to the platen 12, or to another drive source, it only being necessary that the lowermost sheet of paper is fed into the platen 12.

In order to remove paper from the platen 12, the second driven gear 44 is coupled as by a shaft 45A (see FIG. 2) which also extends laterally of the tray 21, the shaft 45A being connected to a pair of spaced apart driven rollers 46 which serve to press the paper against idler rollers (not shown) to effect removal of the paper from the platen 12 and place the finished sheet of paper superimposed on the stack.

The operation of the shingler wheel 29 and the cooperation in the driving action by the sensors 35 and 36 is completely explained in the copending patent application, above identified. However, it should be recognized that the sheet feeder 20 may be controlled by a simple timing device which permits a time out of the amount of time taken to move a bottom sheet during the operation of the shingler wheel 29 upwards or away from the platen 12 and then a simple motor reversal with a sufficient time to permit movement of that bottom sheet beneath the ledge or fingers 26 and 27. Moreover, a simple electromechanical sensor such as a microswitch with a latching circuit may also be employed to control the direction of rotation of the drive motor 34 and its on and off.

Figure 3:
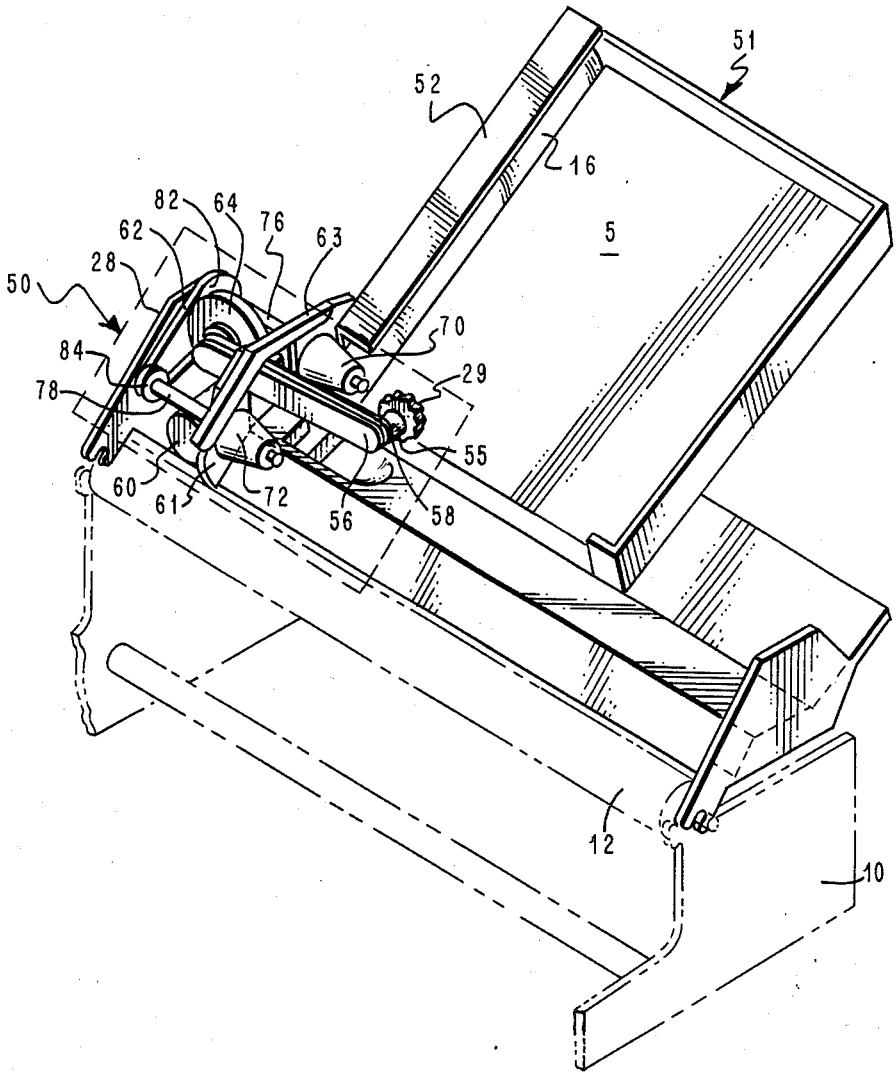
FIG. 3 shows the feed wheel of the present invention mounted in sheet feed apparatus which feeds sheets from the top of the stack.

Referring now to FIG. 3, there is shown a perspective view of sheet feed apparatus fully disclosed in copending U.S. application, Ser. No. 053,462 filed June 29, 1979 by R. E. Hunt in combination with the shingling wheel 29 of the present invention. The frame 28 of the sheet feed apparatus attaches to the frame 10 of a printer at either end of platen 12. Mounted on frame 28 are paper cartridge 51 and separator feed mechanism indicated generally as 50. Shingler wheel 29 is provided for separating sheets from stack 5. Shingler wheel 29 is connected via shaft 55 to arm 56 for movement into and out of contact with stack 5. Shingler wheel 29 is driven through belt 58 by DC motor 60.

Arm 56 is moved into and out of contact with stack 5 by DC motor 60 whose output shaft drivingly engages friction wheel 64. The torque of the internal friction clutch is used to lower and hold down arm 56 and thus shingler wheel 29 in its position of contact with stack 5. The shingler wheel 29 drives the top sheet from the stack 5 against the ramp 16 of the cartridge 51 and into contact with paper guide 52.

Separator feed mechanism 50 additionally is provided with conical feed rollers 70 and 72 for driving a sheet in a direction 90° to that of separation. Conical feed rollers 70 and 72 are rotatably mounted on shafts 76 and 78 respectively. Shaft 76 is mounted in frame 28 and is freely rotatable. Shaft 78 goes through frame 28 and is connected through a gear train (not shown) to platen 12. Pulleys 82 and 84 are mounted on shafts 76 and 78 respectively. Timing belt 62 is provided to keep pulleys 82 and 84 and thus conical rollers 70 and 72 synchronized. As is well known in the art, conical rollers perform the dual function of feeding and aligning sheets.

Also shown in FIG. 3 is frame piece 63 adjacent conical feed roller 72. Frame piece 63 is provided as a sheet exit guide. The printed sheet is driven away from the platen 12 and between conical roller 72 and frame piece 63 in a manner similar to that disclosed in U.S. Pat. No. 3,671,719 to G. H. May, assigned to the same assignee as the present invention.

Figure 4:
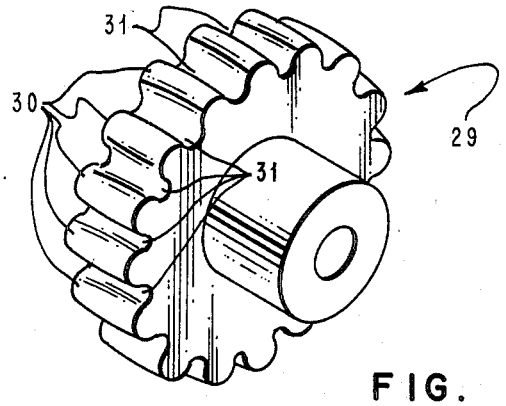
FIG. 4 is a perspective view of the feed wheel of the present invention.

Referring now to FIG. 4, a close-up perspective view of the shingler wheel 29 of the present invention is shown. The shingler wheel 29 includes a gear-shaped roller having a plurality of rounded cogs 30 spaced equally apart about its edge by spaces 31. The cogs (protrusions) 30 are generally barrel-shaped half cylinders whose end radii are equal and less than the center radius. The number and diameter of the cogs 30 may vary as well as the spacing between cogs. However, in the preferred embodiment, 18 cogs having a center radius of approximately 2.4 mm and spaced approximately 20° from center to center are used. The shingler wheel 29 may be constructed from a base plastic material such as Acrylonitrile-Butadiene-Styrene (ABS) which may be injection molded. A nickel substrate is electroplated on the ABS base after injection molding and followed by a flash copper coating. A final coating of polished chrome is applied over the copper coating. In the preferred embodiment of the shingler wheel 29, the polished chrome is applied to a thickness of 0.0127–0.0254 mm. Bright nickel or teflon may also be used as the final coating material. However, teflon has diminished wear characteristics as compared to bright chrome or bright nickel. The major requirement for the final coating material is that the coefficient of friction between it and the sheet of paper being shingled is less than the coefficient of friction between the sheet of paper being shingled and the adjacent sheet of paper.

Thus the shingler wheel of the present invention provides a simple and economical paper feed capability for a typewriter, especially being adapted to an automatic typewriter which will permit self-feeding of sheets of paper in a position for printing.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed.

What is claimed is:

1. A shingler wheel for shingling sheets of paper stacked in a paper feed apparatus comprising:

a stack of paper including sheets having a predetermined coefficient of friction between adjacent sheets;

a unitarily constructed round rotatable member having a plurality of fixed round protrusions about its periphery for engaging the outermost sheet of a stack of paper to be shingled, said round protrusions having said lower coefficient of friction with said outermost sheet than said outermost sheet has with the next adjacent sheet.

2. The shingler wheel of claim 1 wherein said protrusions are curved such that the end radii of said protrusions are equal and less than the center radius of said protrusions.

3. The shingler wheel of claim 1 or claim 2 wherein said protrusions are of polished chrome construction.

4. Sheet feed apparatus comprising:

a stack of sheets having a predetermined coefficient of friction between adjacent sheets;

means for holding said stack of sheets;

a unitarily constructed rotatable member mounted adjacent the top surface of the outermost sheet in said stack and rotatable along the feed path of said sheets, said rotatable member having a plurality of fixed curved protrusions about the periphery thereof; and means for rotating said rotatable member along said feed path into peripheral engagement of said protrusions with said outermost sheet, said protrusions having a lower coefficient of friction with said outermost sheet than said outermost sheet has with its adjacent sheet, whereby said outermost sheet and its adjacent sheets are shingled.

5. Sheet feed apparatus comprising:

a stack of sheets having a predetermined coefficient of friction between adjacent sheets;

means for holding said stack of sheets;

a unitarily constructed rotatable member mounted adjacent the bottom surface of the innermost sheet in said stack and rotatable along the feed path of said sheets, said rotatable member having a plurality of fixed curved protrusions about the periphery thereof; and means for rotating said rotatable member along said feed path with said protrusions engaging said innermost sheet, said protrusions having a lower coefficient of friction with said innermost sheet than said innermost sheet has with its adjacent sheet, whereby said innermost sheet and its adjacent sheets are shingled.

6. The sheet feed apparatus of claim 4 or claim 5 wherein said curved protrusions are curved such that the end radii of said protrusions are equal and less than the center radius of said protrusions.

7. The sheet feed apparatus of claim 4 or claim 5 wherein said protrusions are of polished chrome construction.

8. The sheet feed apparatus of claim 4 or claim 5 wherein said protrusions are spaced approximately 20 degrees apart.

9. The unitarily constructed shingler wheel of claim 1 wherein said protrusions are spaced equally about the periphery of said round rotatable member.

* * * * *